US006379109B1

(12) United States Patent
Senior, Jr. et al.

(10) Patent No.: US 6,379,109 B1
(45) Date of Patent: Apr. 30, 2002

(54) METHOD AND APPARATUS FOR DETECTING AND REMOVING OBSTRUCTIONS IN MECHANICAL AERATORS

(76) Inventors: Roy F. Senior, Jr., 4545 E. Lincoln; Clifford Jon Taylor, 3585 E. Date Ave., both of Fresno, CA (US) 93725

( * ) Notice: Subject to any disclaimer, the term of this patent is extended or adjusted under 35 U.S.C. 154(b) by 0 days.

(21) Appl. No.: 09/569,999

(22) Filed: May 12, 2000

(51) Int. Cl.[7] ..... F04D 29/60
(52) U.S. Cl. ..... 415/7; 210/219
(58) Field of Search ..... 415/7, 13, 119; 210/219, 144, 145

(56) References Cited

U.S. PATENT DOCUMENTS

| | | | | |
|---|---|---|---|---|
| 3,195,034 A | | 7/1965 | Bensema | |
| 4,211,654 A | | 7/1980 | Weber et al. | |
| 4,465,645 A | * | 8/1984 | Kaelin | 415/7 |
| 4,468,358 A | * | 8/1984 | Haegeman | 210/219 |
| 4,540,528 A | * | 9/1985 | Haegeman | 210/219 |
| 5,011,372 A | * | 4/1991 | Nigrelli et al. | 415/7 |
| 5,160,876 A | | 11/1992 | Niinai et al. | |
| 5,285,973 A | | 2/1994 | Goforth et al. | |
| 5,496,254 A | | 3/1996 | Keller et al. | |
| 5,595,474 A | | 1/1997 | Girard | |
| 5,879,279 A | | 3/1999 | Berger et al. | |

* cited by examiner

*Primary Examiner*—John Kwon
(74) *Attorney, Agent, or Firm*—Charles E. Cates

(57) ABSTRACT

Because mechanical aerators are located in a pond of liquid and, therefore, not subject to convenient visual monitoring by operations personnel, it is desirable to have a method for automatically detecting and dislodging debris which become caught on the aerator propeller. The present invention includes a waterproof vibration sensor mounted within sensing range of the rotating shaft of the aerator propeller. The sensor is operably connected to the propeller motor so that when the sensor detects excessive rotating shaft vibrations caused by debris attached to the propeller, the motor is automatically shut down and then run in the reverse direction causing the debris to be thrown off the propeller. Once the debris have been dislocated from the propeller, the motor is restarted in the forward direction. If the sensor continues to detect excessive motor shaft vibration, the motor will once again be shut down and then run in the reverse direction. If after a predetermined number of reversals and restarts in the forward direction, the debris have not been removed from the propeller, an alarm will be activated signaling the operations personnel that the aerator requires operator attention.

16 Claims, 3 Drawing Sheets

METHOD AND APPARATUS FOR DETECTING AND REMOVING OBSTRUCTIONS IN MECHANICAL AERATORS

This invention relates to a new method and apparatus for detecting the vibration of the propeller blades in mechanical aerators which have become obstructed by debris, and further relates to a means for removing the obstructing debris from the aerator blades.

BACKGROUND OF THE INVENTION

Mechanical aerators are commonly used by textile and chemical companies, pulp and paper mills, food processors and municipalities to increase the oxygen content in standing bodies of liquid. Where impurities are present in liquid, an increased oxygen level supports microbes, which remove and process the impurities. For example, microbial breakdown of bacteria is an essential step in sewage treatment. Mechanical aerators are typically positioned at intervals in a pond of liquid, and, therefore, it is not easy for operations personnel to visually monitor the aerators.

Commonly, mechanical aerators include a float or platform to support the aerator in the liquid, a propeller to draw the liquid through the aerator, and a motor and shaft to turn the propeller. From a bottom passage, liquid enters the aerator and is lifted by the propeller through a top passage and out of the aerator. The formation of the top passage directs the liquid exiting the aerator upward and away form the device so that liquid droplets exiting the aerator descend between 2 and 6 feet before reaching the surface of the liquid. As the exiting droplets descend, they are exposed to the atmospheric gases, which are 21% oxygen.

A problem occurs when rags or other debris are drawn into the aerator and become attached to the propeller. Typically the propeller, turning at 1760 to 1800 rpm, is located 2 to 4 feet below the motor and has no end stabilization to prevent its horizontal movement. Debris can attach to the propeller causing an imbalance in the propeller. The imbalance in the propeller causes vibrations which are transmitted up the motor shaft and into the motor, ultimately causing the motor to fail. This problem is common, and, as a result, the life of a mechanical aerator motor in some cases is less than 1 year.

SUMMARY OF THE INVENTION

Because mechanical aerators are located in a pond of liquid, and, therefore, not subject to convenient visual monitoring by operations personnel, it is desirable to have a means of automatically detecting and dislodging debris which becomes caught on the aerator propeller. In order to prevent mechanical aerator motors from failing as described above, the method and apparatus of the present invention provides a means for detecting the excessive vibration of the propeller blades in mechanical aerators which occurs when the blades have become obstructed by debris, such as rags or other materials. The present invention includes a waterproof vibration sensor mounted within sensing range of the rotating shaft of the aerator propeller. The sensor is operably connected to the propeller motor so that when the sensor detects excessive motor shaft vibrations caused by debris attached to the propeller, the motor is automatically shut down and then run in the reverse direction causing the debris to be thrown off the propeller. Once the debris have been dislocated from the propeller, the motor is restarted in the forward direction. If the sensor continues to detect excessive motor shaft vibration, the motor will once again be shut down and then run in the reverse direction. If after a predetermined number of reversals and restarts in the forward direction, the debris have not been removed from the propeller, an alarm will be activated signaling the operations personnel that the aerator requires operator attention.

If the automatic propeller reversal and restart in the forward direction fails to dislocate the debris, the system can be manually run in the forward or reverse direction as desired by the operator. Consequently, the present invention also provides a means for manually controlling shut down, reversal, and restart of the propeller motor to remove debris.

The present invention also includes an alarm means for indicating when the aerator motor has failed due to motor breakdown, such as bearing deterioration and wire breakage.

DETAILED DESCRIPTION OF THE INVENTION

Figure 1:
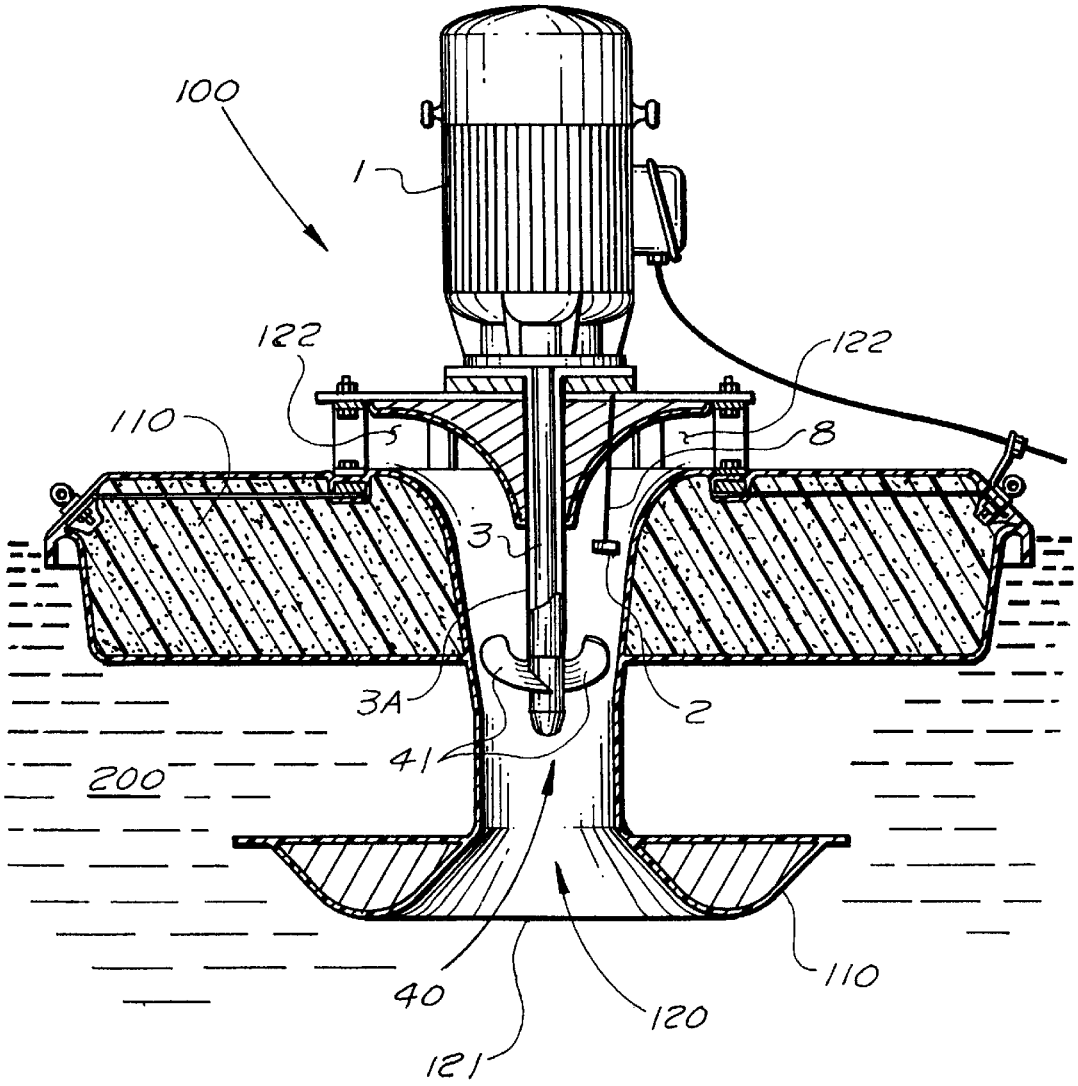
FIG. 1 is a sectional view of a conventional mechanical floating aerator with the vibration sensor of the present invention attached thereto.

As shown in FIG. 1, mechanical aerator 100 includes propeller motor 1, rotating shaft 3, and propeller 40. Rotating shaft 3 is operably connected to propeller 40, which is provided with blades 41. The aerator shown in FIG. 1 is a floating aerator, it being understood that the invention described herein is equally applicable to aerators mounted on platforms. Sometimes during the operation of mechanical aerator 100, debris such as rags will catch on one or the other of blades 41 of propeller 40 causing an imbalance in the propeller. Rotating shaft 3 will then begin to wobble, eventually causing failure of motor 1. Running the motor in the reverse direction for a predetermined period of time can often dislodge debris from propeller 40. The present invention provides a means for detecting the excessive vibration of the propeller blades in mechanical aerators which occurs when the blades have become obstructed by debris, such as rags or other materials The mechanical aerator 100 shown in FIG. 1 is supported in pond 200 by float assembly 110. Propeller motor 1 is mounted to float assembly 110. Channel 120 extends through float assembly 110 and is provided with a lower entrance 121 and upper angled passage 122. Rotating shaft 3 is operably connected to motor 1 and is extended through protective tube 3A about 3 or 4 feet into channel 120. Propeller 40 is mounted on the end of rotating shaft 3 within channel 120. When energized, motor 1 operates to turn rotating shaft 3, which in turn causes the rotation of propeller 40. As propeller 40 rotates, the liquid in channel 120 is lifted higher in the channel until the liquid exits through upper angled passage 122.

During operation of motor 1, liquid from pond 200 continually enters lower entrance 121 of channel 120, creating a constant flow of liquid from pond 200, into entrance 121, through channel 120, and out upper angled passage 122. Liquid exiting through angled passage 122 exits at an angle and under sufficient pressure so that the liquid it falls about 2 to 6 feet before reaching the surface of pond 200. As the liquid falls, oxygen is mixed in with the descending liquid droplets.

Figure 2:
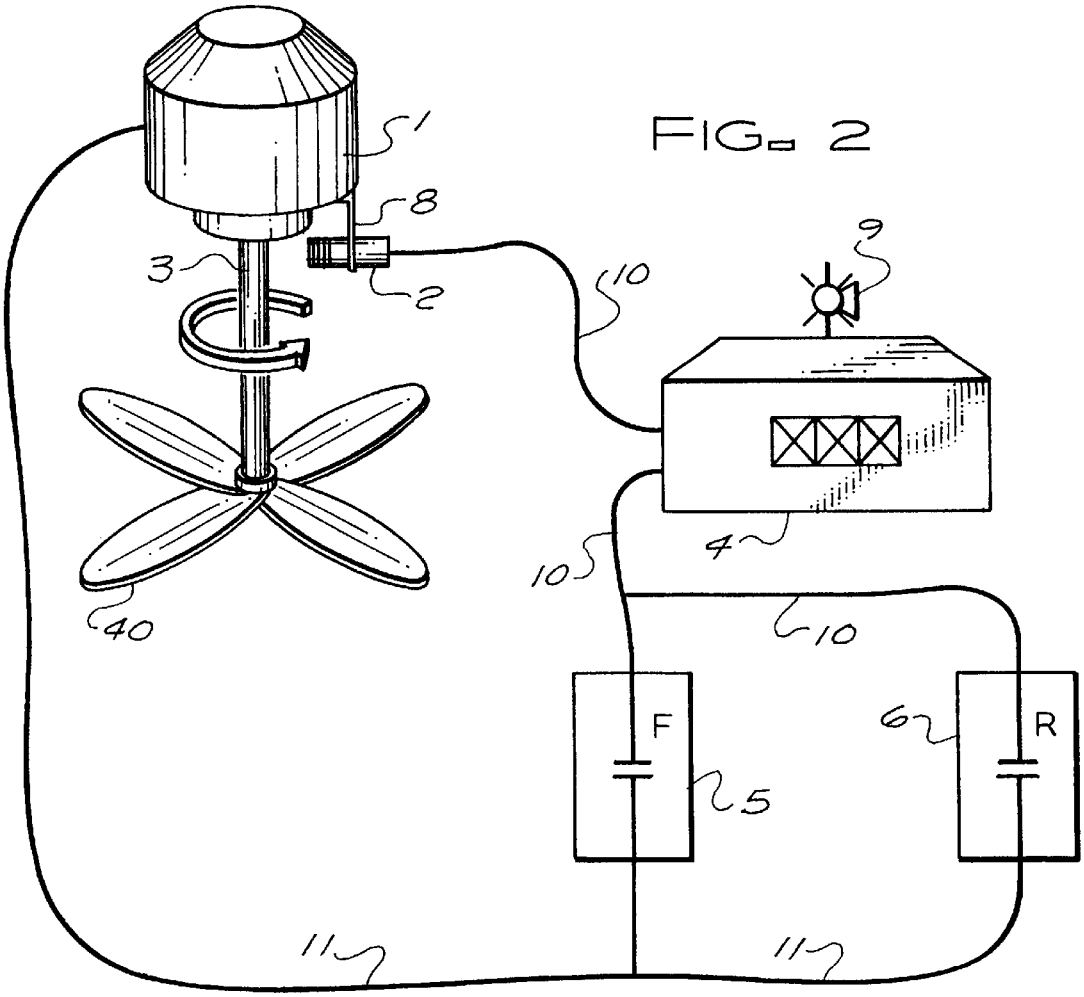
FIG. 2 is a schematic representation of the electronic components of the method and apparatus of the present invention.

As shown in FIG. 1 and schematically in FIG. 2, vibration sensor 2 is mounted on mechanical aerator 100 by means of bracket 8. A suitable vibration sensor is available from Balmac, Inc. as vibration transmitter model 191-1. Sensor 2 is positioned within sensing range of rotating shaft 3. Sensor 2 detects horizontal displacement of rotating shaft 3 caused by debris becoming attached to and obstructing blades 41 of propeller 40.

The electric motor 1 as shown on the power schematic is typically powered by an alternating current power source 25. This power source 25 and motor 1 are protected from electrical damage by circuit breaker 26 and thermal overload contacts 27. The control system as shown on the control schematic is normally powered by an alternating current (AC) or direct current (DC) power source 12. This power source and the various devices shown on the control schematic are protected from electrical damage by circuit breaker 13 and fuse 14.

Figure 3:
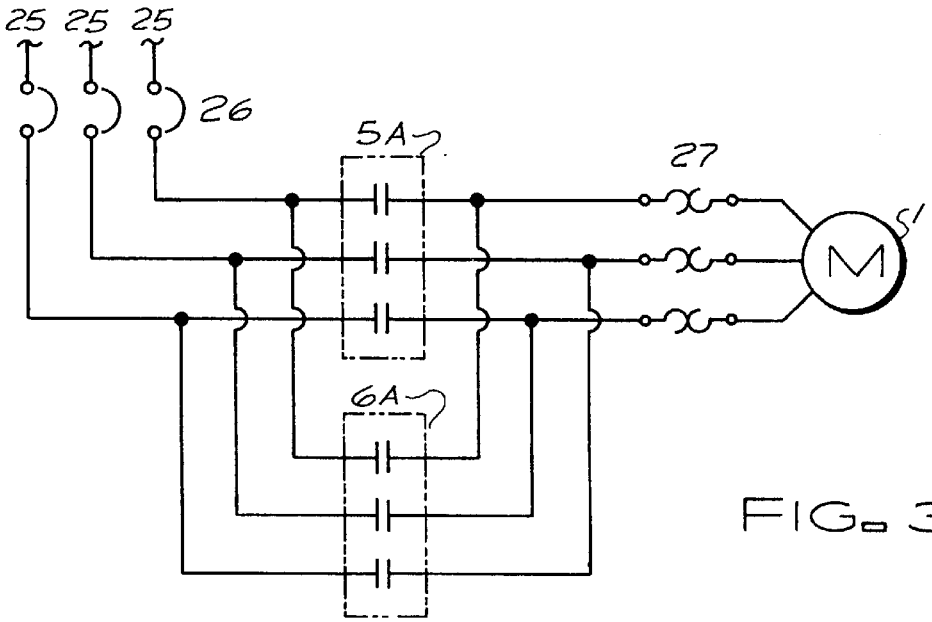
FIG. 3 is a schematic diagram of the power circuitry used to power the motor.
Figure 4:
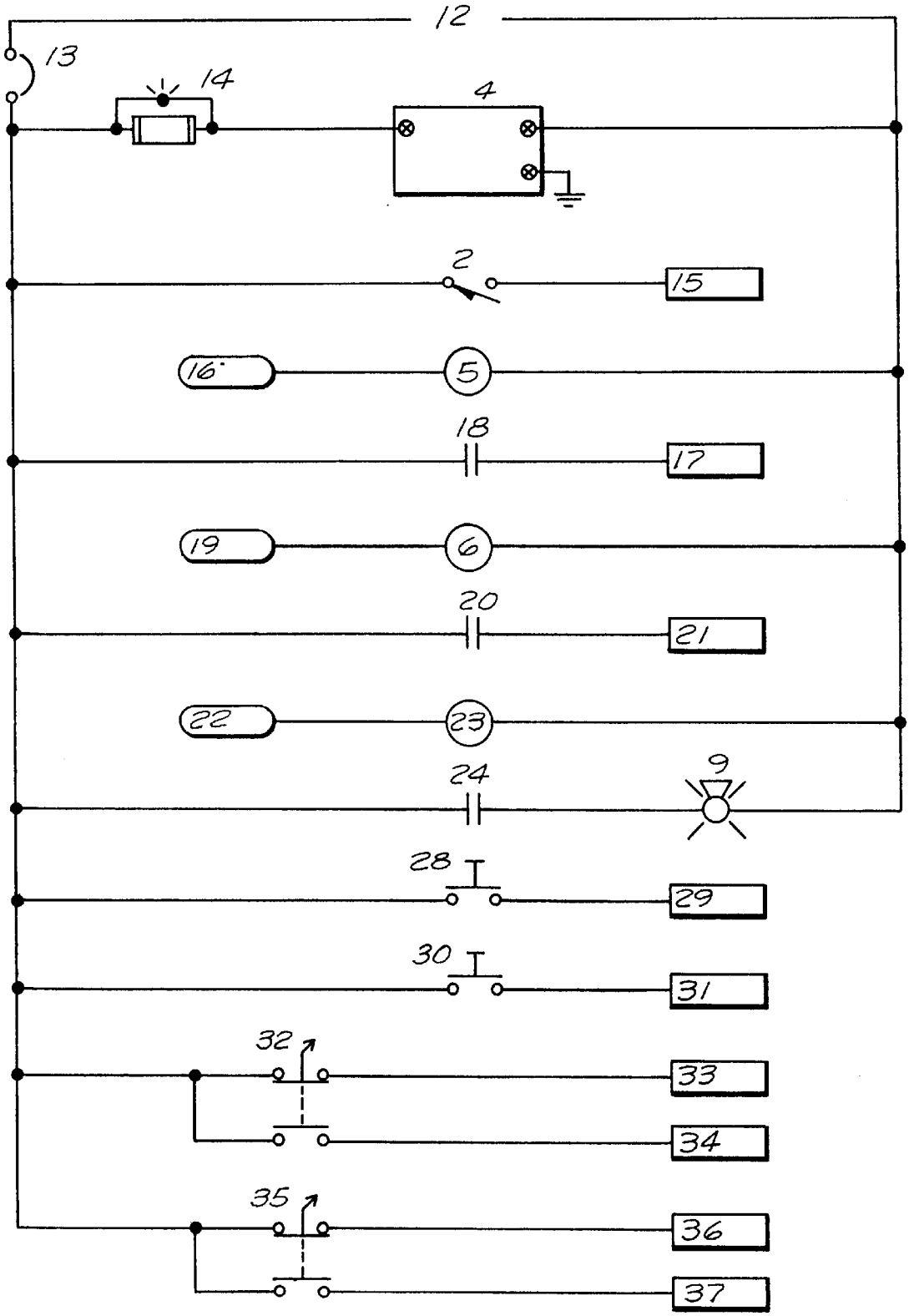
FIG. 4 is a schematic diagram of the control circuitry.

FIGS. 3 and 4 show the power and control circuitry of the present invention. In the automatic mode, the controller 4 controls the motor 1 in the forward or reverse direction based on the signal 15 through the control wire 10 from the vibration sensor 2.

A suitable controller is available from Allen Bradley as Micrologix 1500 Programmable Controller. To start the system in the automatic mode, the manual/auto switch 32 is set to the automatic mode position. The automatic mode position input signal 34 to the controller 4 is then on. Next, the start button 28 is depressed, which sends the start button input signal 29 to the controller 4 and turns on the controller. The forward start output signal 16 from the controller 4 energizes the forward start coil 5 through control wire 10, which closes the forward start contactor 5A to start the motor 1 through power wire 11 in the forward direction. The forward start coil 5 will start first regardless of the forward/reverse switch 35 position when in automatic mode. Upon startup in the automatic mode, the motor 1 always starts in the forward direction.

During the automatic operation, if the vibration transducer 2 detects an amount of horizontal displacement from the rotating shaft 3 which exceeds a predetermined, adjustable set point in the controller 4, the controller 4 will de-energize the forward coil input signal 16 to stop the motor 1. The controller 4 will then wait a predetermined period for the rotating shaft 3 to stop turning. The reverse start output signal 19 from the controller 4 next energizes the reverse start coil 6. The reverse start contactor 6A then starts the motor 1 in the reverse direction for a period of time that is adjustable from the controller 4. When the reverse run time is finished, the reverse start output signal 19 is de-energized to stop the motor 1. The controller 4 will wait for a predetermined period of time for the rotating shaft 3 to stop turning. The controller 4 will then restart the motor 1 in the forward direction. If, as a result of debris continuing to obstruct propeller 40, the horizontal displacement still exceeds the set point of vibration sensor 2, the controller 4 will repeat the above-described procedure of stopping motor 1, starting motor 1 in the reverse direction, stopping motor the second time, and then finally restarting the motor in the forward direction.

If the debris have not been dislodged from propeller 40 causing the horizontal displacement to still exceed the set point after a pre-programmed number of reversals and restarts in the forward direction, the controller 4 will de-energize the forward start coil 5 and energize the alarm coil 23 which will close the relay contact 24 to give alarm indication 9 to the operations personnel. The alarm can be given as a signal light, as an alarm sound, or as a signal and sound. The motor 4 will not restart again until the start push button 28 is pushed.

If an alarm condition exists, the operating personnel must investigate what is causing the problem. In the manual mode of operation, the operator has the opportunity to fix any problems after the automatic correction procedure described above has failed and an alarm has been given. In the manual mode, the rotating shaft 3 may be run in the forward or reverse direction as desired by the operations personnel. To run the motor 1 in the forward direction, the manual/auto switch 32 is set to the manual mode position, so the manual input signal 33 is on to the controller. The forward/reverse switch 35 is set to the forward position, sending the forward input signal 36 to the controller. The start button 28 is then actuated sending the forward start contactor signal 16 from the controller 4 and energizing the forward start contactor coil 5. To reverse the direction, stop button 30 is actuated to stop the motor 1. When stop button 30 is actuated, a stop button input signal 31 is sent to controller 4, which turns off the forward start output signal 16 and stops the motor 1. Once rotating shaft 3 has stopped turning, the forward/reverse switch 35 is turned to the reverse position, which sends reverse input signal 37 to controller 4. Start button 28 is then actuated, which sends reverse start output signal 19 from the controller 4 and energizes the reverse start contactor coil 6 and closes the reverse start contactor 6A.

The operating personnel can start the motor 1 in the forward or reverse direction as often as needed in manual mode and no alarm will be issued. After the operator fixes the problem, the system may be put back into automatic mode by switching the manual/auto switch 32 to automatic mode position. When switch 32 is set to automatic mode, automatic input signal 34 is sent to controller 4. Next, start button 28 is actuated. Controller 4 will then automatically start the forward start output signal 16 to energize the forward start coil 5.

In addition to the means for detecting and removing obstructions described above, it is also desirable to have a means for indicating an alarm when motor 1 is in need of repair. During operation, motors can suffer break downs which, if not remedied right away, can cause extensive and expensive damage to the motor. Common problems include bearing deterioration and wire breakage. In aerator motors, it is also possible that a very large piece of debris can enter channel 120 and freeze motor 1. It is therefore desirable to have an alarm means for indicating when a motor has failed.

During normal forward motor operation, the motor forward start coil 5 is energized. When start coil 5 is energized, forward run auxiliary contact 18 closes and sends forward run input signal 17 to controller 4. If the motor is tripped out, the forward run auxiliary contact 18 will open and the run/auxiliary input signal 17 will turn off. The controller 4 will energize the alarm output signal 22, which energizes the alarm relay 23. The alarm relay contact 24 will close to energize the alarm horn/indicator 9.

During normal reverse motor operation, the motor reverse start coil 6 is energized. When reverse start coil 6 is energized, reverse run auxiliary contact 20 closes and sends reverse auxiliary input signal 21 to controller 4. If the motor trips out, the reverse run auxiliary contact signal 21 to the controller 4 is off. The alarm relay 23 is energized. The alarm relay contact 24 will close to energize the alarm horn/indicator 9.

The run auxiliary trip alarms work for both manual and automatic modes. After the motor trips out, the controller 4 will not restart the motor until the start button 28 is actuated.

What is claimed is:

1. A method for automatically detecting and removing debris obstructing a propeller in a mechanical aerator, said mechanical aerator having a motor which turns a rotating shaft connected to said propeller, said method comprising the steps of:

a. Starting said motor in a first direction so that said rotating shaft turns in said first direction;

b. Positioning a sensor within sensing range of said rotating shaft, said sensor being set to detect excessive horizontal displacement of said shaft;

c. Providing a means for automatically stopping said motor when said sensor detects excessive horizontal displacement;

d. Providing a means for automatically restarting said motor in a second direction so that said rotating shaft turns in a second direction opposite of said first direction for a predetermined period of time;

e. Providing a means for automatically stopping said motor when said motor has run in said second direction for said predetermined period of time;

f. Providing a means for automatically restarting said motor in said first direction; and g. Continuing to monitor said rotating shaft for excessive horizontal displacement.

2. The method of claim 1 further comprising:

a. Providing means for stopping said motor when said sensor continues to sense excessive horizontal displacement of said rotating shaft;

b. Providing a means for automatically restarting said motor in a second direction so that said rotating shaft turns in a second direction opposite of said first direction for a predetermined period of time;

c. Providing a means for automatically stopping said motor when said motor has run in said second direction for said predetermined period of time; and d. Providing a means for automatically restarting said motor in said first direction.

3. The method of claim 2 wherein said motor will only automatically restart in said first direction a predetermined number of times.

4. The method of claim 3 further including automatically stopping and not restarting said motor when said sensor continues to detect excessive horizontal displacement of said rotating shaft after said motor has been automatically restarted in said first direction said predetermined number of times.

5. The method of claim 4 further including providing an alarm means for alerting operations personnel when said sensor continues to detect excessive horizontal displacement of said rotating shaft after said motor has been automatically restarted in said first direction said predetermined number of times.

6. The method of claim 2 further including a means for manually stopping said motor, means for manually restarting said motor in a second direction so that said rotating shaft turns in a second direction opposite of said first direction, and means for manually restarting said motor in said first direction.

7. The method of claim 1 further including an alarm means for alerting operations personnel when said motor has failed.

8. The combination of a mechanical aerator having a motor, a channel for conveying liquid, a propeller operated by said motor, said propeller positioned within said channel and operably connected to said motor by a rotating shaft, and a means for sensing horizontal displacement of said shaft, said sensing means being disposed within said channel.

9. The combination of claim 8 further including a means responsive to said sensor for stopping said motor when said sensor detects excessive horizontal displacement of said shaft.

10. The combination of claim 9 further including a means for restarting said motor in a second direction so that said rotating shaft turns in a second direction for a predetermined period of time.

11. The combination of claim 10 further including a means for stopping said motor when said motor has run in said second direction for said predetermined period of time.

12. The combination of claim 11 further including a means for restarting said motor in the initial direction.

13. The combination of claim 12 further including stopping and not restarting said motor when said sensor continues to detect excessive horizontal displacement of said rotating shaft after said motor has been restarted in said initial direction a predetermined number of times.

14. The combination of claim 13 further including providing an alarm means for alerting operations personnel when said sensor continues to detect excessive horizontal displacement of said rotating shaft after said motor has been automatically restarted in said first direction said predetermined number of times.

15. The combination of claim 8 further including a means for manually stopping said motor, means for manually restarting said motor in a second direction so that said rotating shaft turns in a second direction opposite of said initial direction, and means for manually restarting said motor in said initial direction.

16. The combination of claim 8 further including an alarm means for alerting operations personnel when said motor has failed.

* * * * *